US006843550B2

(12) United States Patent
Waller et al.

(10) Patent No.: US 6,843,550 B2
(45) Date of Patent: Jan. 18, 2005

(54) PRINTHEAD SERVICING MECHANISM AND METHOD

(75) Inventors: David J. Waller, Vancouver, WA (US); Kit Harper, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/420,313

(22) Filed: Apr. 22, 2003

(65) Prior Publication Data

US 2004/0212656 A1 Oct. 28, 2004

(51) Int. Cl.[7] ..... B41J 2/165
(52) U.S. Cl. ..... 347/29; 347/32
(58) Field of Search ..... 347/22, 24, 39–33

(56) References Cited

U.S. PATENT DOCUMENTS 5,257,044 A 10/1993 Carlotta et al.
5,867,187 A * 2/1999 Toniolo ..... 347/32
6,309,044 B1 10/2001 Gaarder

* cited by examiner

*Primary Examiner*—Shih-Wen Hsieh

(57) ABSTRACT

A printhead servicing mechanism comprises a printhead capping device that moves between a storage position and a printhead capping position, and a crank arm assembly that moves the printhead capping device between the storage and capping positions.

31 Claims, 5 Drawing Sheets

PRINTHEAD SERVICING MECHANISM AND METHOD

BACKGROUND

Printing mechanisms, such as those used in desktop printers, may use one or more print cartridges, sometimes referred to as "pens," which may shoot drops of liquid colorant, referred to generally herein as "ink," onto a page. Each print cartridge may have a printhead formed with very small nozzles through which the ink drops are fired. To print an image, the printhead carriage carrying the printhead may be propelled back and forth across the page, firing drops of ink in a desired pattern as it moves. The particular ink ejection mechanism within the printhead may take on a variety of different forms known to those skilled in the art, such as those using piezo-electric or thermal printhead technology.

To clean and protect the printhead, a "service station" mechanism may be mounted within the printer chassis so the printhead can be moved over the station for maintenance. For storage, or during non-printing periods, the service stations may include a capping system which seals the printhead nozzles from contaminants and drying. To facilitate priming, some printers may have priming caps that are connected to a pumping unit to draw a vacuum on the printhead. During operation, partial occlusions or clogs in the printhead may be periodically cleared by firing a number of drops of ink through each of the nozzles in a clearing or purging process known as "spitting." The waste ink may be collected at a spitting reservoir portion of the service station, known as a "spittoon." After spitting, uncapping, or occasionally during printing, most service stations have a flexible wiper, or a more rigid spring-loaded wiper, that may wipe the printhead surface to remove ink residue, as well as any paper dust or other debris that has collected on the printhead. After wiping of the printhead by the wiper, the wiper may be scraped by a scraper to remove ink residue from the wiper.

The capping, spitting and wiping mechanisms of the service station may all be provided on a single service station sled for a variety of reasons, including reducing the space requirements of the service station. These multi-function service station sleds may not cap or uncap the printhead without also wiping the printhead and, in some cases, then scraping the wiper. Accordingly, a predetermined torque may be required in order to effect movement of the sled due to the multiple number of tasks that the sled may perform during each movement. Unnecessary wear and tear of the cap and/or the wiper may also occur because capping and/or wiping may not be required or desired during each movement of the sled. Moreover, the wiper, when it is scraped, may tend to flick ink from the wiper back onto the wiper or onto the printhead and the printhead carriage.

SUMMARY

One embodiment of a printhead servicing mechanism comprises a printhead capping device that moves between a storage position and a printhead capping position, and a crank arm assembly that moves the printhead capping device between the storage and capping positions.

DETAILED DESCRIPTION OF THE DRAWINGS

Figure 1:
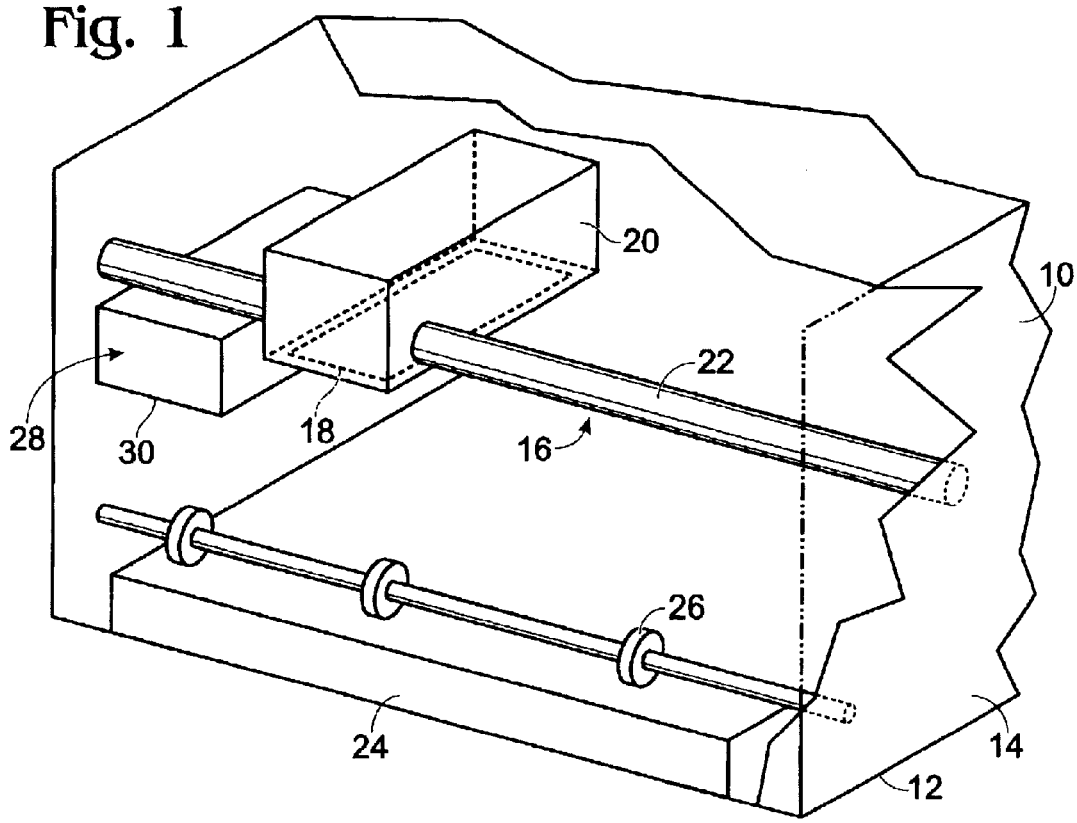
FIG. 1 is a front view of one form of a printing mechanism including one embodiment of the printhead servicing mechanism of the present invention.

FIG. 1 illustrates one embodiment of a printing mechanism constructed in accordance with the present invention. The printing mechanism may be used for the printing of business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of a printer 10. However, other printing mechanisms may include the printhead servicing mechanism of the present invention.

While it is apparent that the printer's components may vary, the typical printer 10 may include a chassis 12 surrounded by a housing 14 (in this figure chassis 12 is hidden from view by housing 14), typically manufactured of a plastic material. Sheets of print media may be fed through a printzone 16 to a printhead 18 which may be supported by a printhead carriage 20. Printhead 18 may comprise a plate on a lower surface of printhead carriage 20 that defines a printhead plane and that includes nozzles though which the ink is ejected to print an image. Printhead carriage 20 may be movably mounted on a carriage rod 22 for movement there along. The print media may be any type of suitable material, such as paper, card-stock, transparencies, mylar, and the like, but for convenience, the illustrated embodiment is described using a sheet of paper as the print medium. The printer may include a feed tray 24 for storing sheets of paper before printing. A series of motor-driven paper drive rollers 26 (one drive roller shaft including several drive rollers is shown in this view) may be used to move the print media from tray 24 into the printzone 16 for printing. After printing an image on a sheet of print media, the printhead may be moved into a servicing region 28 for servicing by a printhead servicing mechanism 30. The printhead servicing mechanism 30 will now be described.

Figure 2:
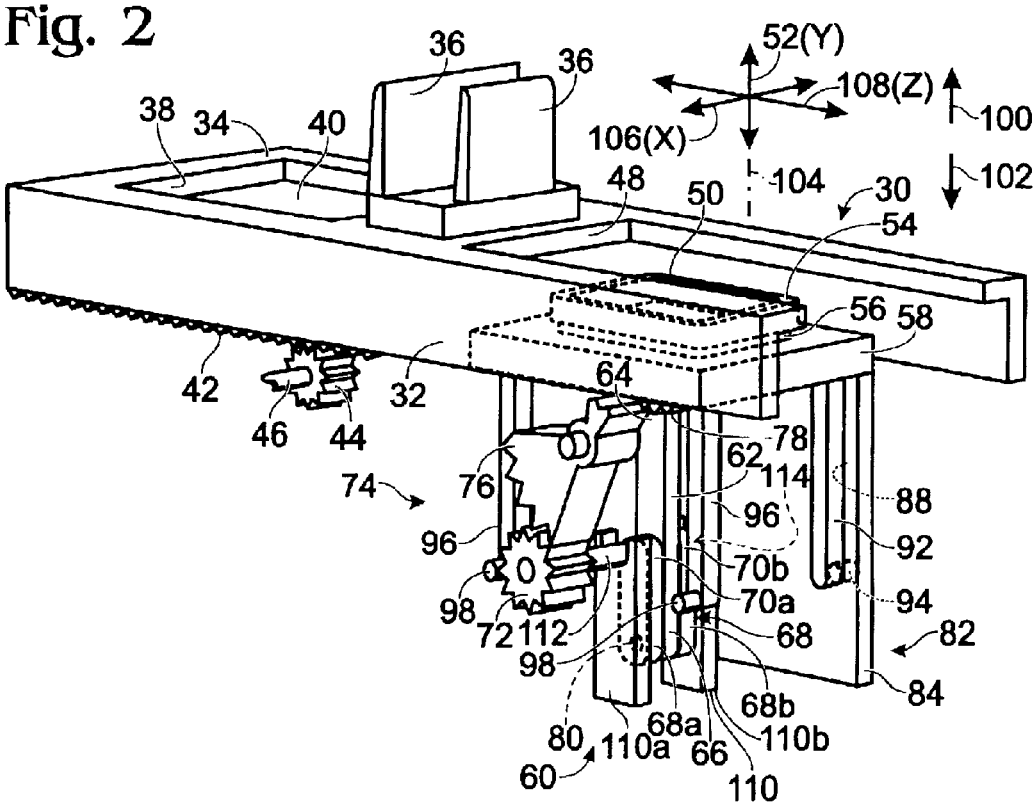
FIG. 2 is a perspective view of one form of a service station of FIG. 1.

FIG. 2 is a perspective view of one form of the servicing mechanism 30 of the present invention. Printhead servicing mechanism 30, in the embodiment shown, may include a servicing sled 32 having a spittoon 34 and a pair of wipers 36. Spittoon 34 may include a recess 38 having a surface 40 positioned therein for receiving ink spit from printhead 18 (see FIG. 1). Sled 32 may include a rack 42 for engagement with a service station drive shaft pinion 44. In one embodiment, rack 42 may extend along the entire lower edge surface of sled 32. However, for ease of illustration in the figure shown, rack 42 is shown extending along approximately half of the lower edge surface of sled 32. Pinion 44 and, therefore, sled 32, may be driven in the "z" direction axis 108 by a dedicated motorized transmission (not shown), or by a feed roller shaft 46. Sled 32 may further include a cutaway portion 48 which allows movement of a capping system 50 through sled 32 along "y" direction axis 52.

Capping system 50 may include a cap 54, mounted on a cap gimbal 56, which in turn may be mounted on a cap carrier 58. Gimbal 56 may allow a slight rocking motion of cap 54 with respect to cap carrier 58 such that upon contact of cap 54 with printhead 18 (see FIG. 1), the cap may align itself with the printhead so that the upper rim of cap 54 may squarely abut against the printhead surface. In this manner a seal of printhead 18 may be accomplished. Positioned below cap carrier 58 may be a crank arm assembly 60 including a linkage arm 62 which may be secured at a first end 64 to cap carrier 58 and at a second end 66 between the two arms 68*a* and 68*b* of a crank 68. Crank arm 68*a* may be secured at its opposite end 70*a* to a first gear 72 of a compound gear assembly 74. First gear 72 may be engaged with a second, larger gear 76 that may be selectively engaged by a rack 78 on sled 32. Rack 78, for ease of illustration is shown on a lower edge surface of sled 32. However, in another embodiment rack 78 may be positioned inwardly from an edge surface of sled 32 such that rack 78 is not aligned with rack 42, which may also be positioned on a lower surface of sled 32. "Compound" gear assembly may be interpreted as meaning a gear assembly wherein rotation of one gear through a first angle may result in rotation of a second gear through a second angle that is different than the first angle. In the embodiment shown, compound gear assembly 74 comprises first and second gears 72 and 76, respectively, wherein the first and second gears are of different size so as to achieve differing angles of rotation when the two gears rotationally mate with one another. In other embodiments, gears 72 and 76 may be of the same size or may be of a different size than the size shown in the illustrated embodiment. Second end 66 of linkage arm 62 and the two arms 68*a* and 68*b* of crank 68 may be pivotally secured together with a fastener 80, also referred to as a pin, shown in dash lines.

Capping system 50 may further include a support structure 82 that may comprise first and second side walls 84 and 86 (see FIG. 3), respectively, wherein each wall may include at least one groove 88 and 90 (see FIG. 3), respectively, therein. Cap carrier 58 may include a first pair of legs 92 each having a projection 94 adapted to be received within groove 88 of side wall 84. Similarly, cap carrier 58 may include a second pair of legs 96 each having a projection 98 adapted to be received within groove 90 of side wall 86 (see FIG. 3). In this manner, movement of crank arm assembly 60 may operate to move cap carrier 58 in an upward direction 100 or in a downward direction 102 parallel to "y" direction 52 and along a capping axis 104, without attendant movement in the "x" or "z" directions 106 and 108, respectively. In other embodiments, cap carrier 58 may include only one leg for contacting either of side walls 84 or 86. In still other embodiments, any alignment device may be utilized to ensure "y" direction 52 movement of cap carrier 58 in response to movement of linkage 62. For example, in an alternate embodiment, legs 92 and 96 may each include a groove therein, wherein side walls 84 and 86 each may include a projection that is received within the grooves of legs 92 and 96, respectively. In another alternate embodiment, projections 94 and 98 may be received within a track on side walls 84 and 86, instead of within a groove as shown in the illustrated embodiment. In yet another alternate embodiment, projections 94 and 98 may be biased against an elongate stop surface by a biasing element such that the projections move along, and in contact with the elongate stop surface. In the embodiment shown, grooves 88 and 90 are each positioned extending vertically. However, in another embodiment, grooves 88 and 90 may be inclined with respect to a vertical axis such that cap carrier 58 may have an inclined upward movement as it is moved from the storage to the capping position.

Support structure 82 may further comprise a crank arm support structure 110 wherein a first wall 110*a* of the structure may support a connecting rod 112 that may connect first gear 72 and arm 68*a* of crank 68 and a second wall 110*b* of the structure that may support a protrusion 114 (shown in dash lines) extending outwardly from crank arm 68*b*. Protrusion 114 and connecting rod 112 may be aligned with a rotational axis of gear 72, and first and second crank arms 68*a* and 68*b* may be fixedly secured together by fastener 80, such that rotation of gear 72 may result in simultaneous rotation of crank arms 68*a* and 68*b*.

Figure 5:
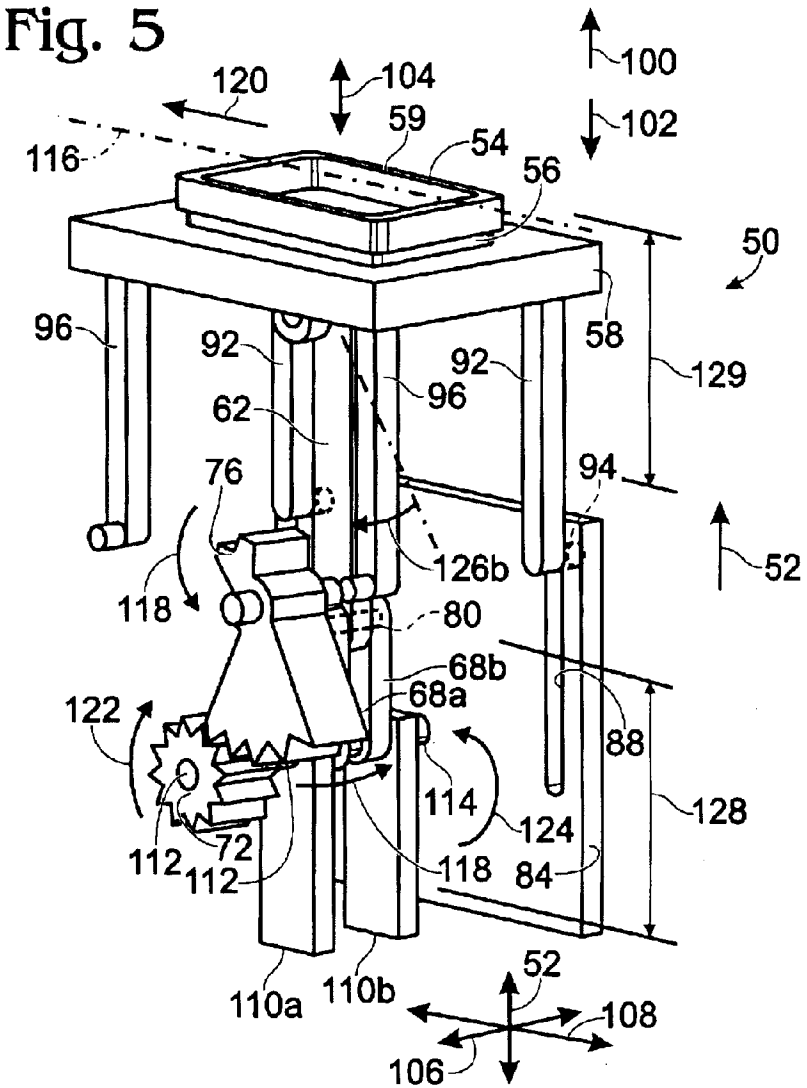
FIGS. 3–5 are perspective views of the capping mechanism of the service station of FIG. 2 in the lowered, half raised, and raised positions, respectively.
Figure 3:
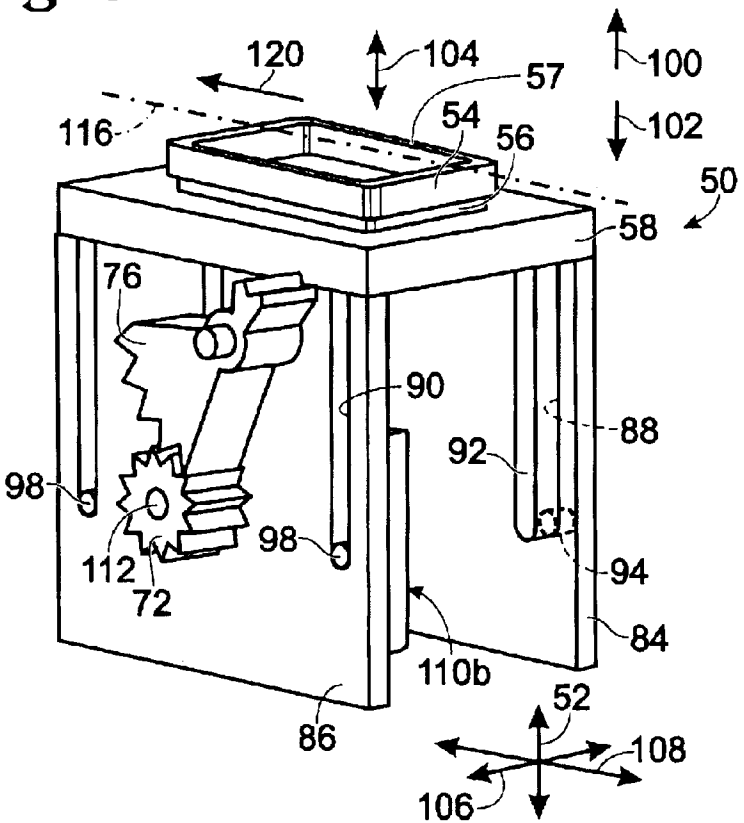
Figure 4:
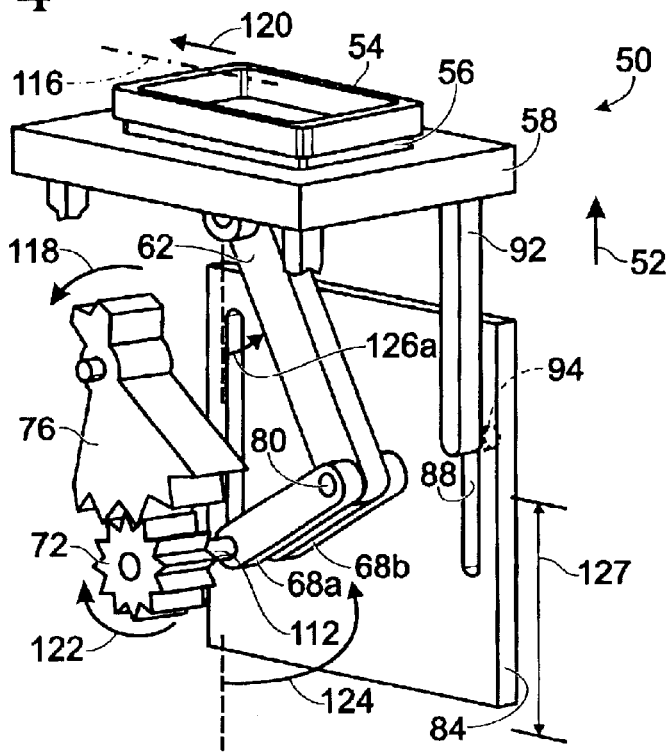

FIGS. 3–5 are perspective views of the capping mechanism 50 of the service station of FIG. 2 in the lowered, half raised, and raised positions, respectively. In particular, in FIG. 3, gear 76 may not have been rotated by contact with rack 78 of sled 32 (see FIG. 2) such that cap carrier 58 may remain in the lowered position. Accordingly, projections 94 of legs 92 may remain in a lower portion of grooves 88 of side wall 84. Similarly, projections 98 of legs 96 may remain in a lower portion of grooves 90 of side wall 86. In this position cap carrier 58 may be positioned below an axis of movement 116 of sled 32 (see FIG. 2) such that the sled may move along a portion of axis of movement 116 without contacting cap 54. In this position, the top surface of cap 54 may define a cap storage plane 57.

In FIG. 4 gear 76 is shown rotated through an angle 118, of approximately fifteen degrees, from the position shown in FIG. 3. Gear 76 may be rotated through angle 118 by contact of gear 76 with rack 78 of sled 32 (see FIG. 2). In particular, movement of sled 32 (see FIG. 2) in direction 120 along axis 116, at a position wherein rack 78 engages gear 76, may result in gear 76 rotating through angle 118. Rotation of gear 76 through angle 118 of approximately fifteen degrees may result in rotation of gear 72 about the axis of rod 112, through an angle 122 of approximately one hundred degrees. Movement of gear 72 through angle 122 of approximately one hundred degrees may cause crank arms 68*a* and 68*b* to rotate through a corresponding angle 124 of approximately one hundred degrees about the rotational axis defined by connecting pin 112 and protrusion 114 (see FIG. 5). Movement of crank arms 68*a* and 68*b* through angle 124 of approximately one hundred degrees may result in a swinging movement of linkage arm 62 through an arc 126*a* of approximately thirty degrees. After such swinging movement through arc 126*a*, fastener 80, which may connect linkage arm 62 to crank arms 68*a* and 68*b*, may be positioned a distance 127, in "y" direction 52 above the initial position of fastener 80, shown in FIG. 3. Distance 127 may be approximately one times the length of crank arms 68*a* and 68*b*. In this position, cap carrier legs 92 and 96 may have moved upwardly with respect to support walls 84 and 86 such that cap 54 may be in approximately a half raised position.

In FIG. 5 gear 76 is shown rotated through an angle 118, of approximately thirty degrees, from the position shown in FIG. 3. Gear 76 may be rotated through angle 118 by contact of gear 76 with rack 78 of sled 32 (see FIG. 2). In particular, movement of sled 32 (see FIG. 2) in direction 120 along axis 116, at a position wherein rack 78 engages gear 76, may result in gear 76 rotating through angle 118. Rotation of gear 76 through angle 118 may result in rotation of gear 72 about the axis of rod 112, through an angle 122 of approximately one hundred and eighty degrees. Movement of gear 72 through angle 122 of approximately one hundred and eighty degrees may cause crank arms 68*a* and 68*b*, and fastener 80, to rotate through a corresponding angle 124 of approximately one hundred and eighty degrees about the rotational axis defined by connecting pin 112 and protrusion 114. Movement of crank arms 68*a* and 68*b* through angle 124 of approximately one hundred and eighty degrees may result in movement of linkage arm 62 through arc 126*a* (see FIG. 4) of approximately thirty degrees, and then return through an arc 126*b* of approximately thirty degrees to the position shown in FIG. 5. After such swinging movement through arcs 126*a* and 126*b*, fastener 80, which connects linkage arm 62 to crank arms 68*a* and 68*b*, may be positioned a distance 128, in "y" direction 52 above the initial position of fastener 80, shown in FIG. 3. Distance 128 may be approximately double the length of the distance from fastener 80 to connecting pin 112. In this position, cap carrier legs 92 and 96 may have moved upwardly with respect to support walls 84 and 86 (see FIG. 3) such that cap 54 may be in a printhead capping position. In this position, the top surface of cap 54 may define a printhead capping plane 59.

In general, gear 76 may be sized such that movement of gear 76 through about an angle 118 in a range of one to forty degrees may move gear 72 through about an angle 122 in a range of one hundred and seventy to one hundred and ninety degrees, which in turn may move crank arms 68*a* and 68*b* through about an angle 124 in a range of one hundred and seventy to one hundred and ninety degrees. In one example, gear 76 may be sized to move through about an angle of three degrees which may cause gear 72 to move through about an angle of one hundred and eighty degrees. In another example, gear 76 may be sized such that it may move through about an angle of twenty five degrees which may move gear 72 through about an angle of one hundred and eighty degrees.

In the embodiment shown, movement of cap 54 upwardly in "y" direction 52 takes place without any appreciable movement in the "x" or "z" directions 106 and 108. Moreover, cap 54 may be moved upwardly about a distance 129, as fastener 80 is moved through vertical distance 128, wherein the crank arms 68*a* and 68*b* may each have a length approximately half of distance 129 and wherein linkage arm 62 may have a length approximately the same as distance 129. Accordingly, capping mechanism 50 may result in "y" movement (i.e., movement in the y direction 52 without any appreciable movement in the x or z directions) of cap 54 through about a distance 129, wherein the "y" dimension storage space required for crank arm assembly 60 is only approximately half of the "y-throw" distance 129 of cap 54. Additionally, due to the "y" direction movement of cap 54, the "x" and "z" dimension storage space requirements of cap 54 may be no larger than cap carrier 58. In other words, the footprint of cap carrier 58 may be the only space required for storing of capping system 50 because the cap carrier does may not travel through a ramped movement in the "x" or "z" directions to reach its upward capping position. The relatively small space requirements for capping system 50, namely a "y" storage space requirement that is only half that of the "y throw" distance 129, and an "x" and "z" storage space requirement that is only as large as the footprint of cap carrier 58, may allow a printing mechanism 10 in which capping system 50 is installed to be manufactured in a relatively small size. Moreover, as will be discussed below, capping system 50 may be operated at selective times so that both capping and wiping need not be conducted during every service of printhead 18 (see FIG. 1).

Figure 6:
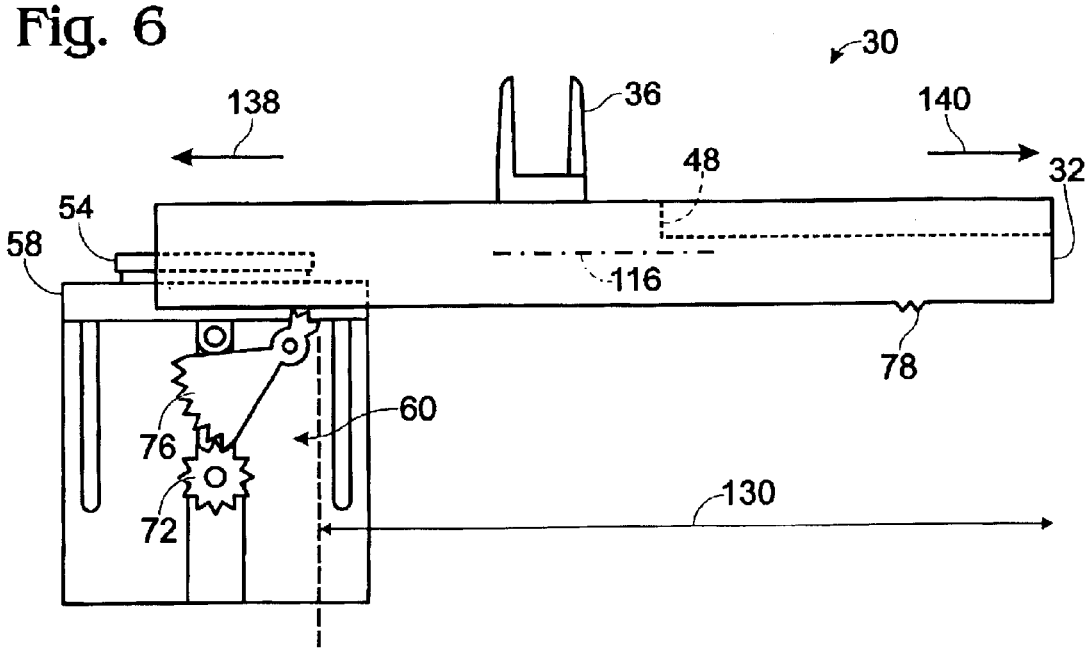
FIGS. 6–9 are side views showing one embodiment of the servicing station sled in a variety of positions.

FIGS. 6–9 are side views showing the servicing station 30 in a variety of positions. FIG. 6 shows sled 32 positioned such that rack 78 of sled 32 may not be in contact with gear 76 of crank arm assembly 60. Sled 32 may move back in forth in directions 138 and 140 without engaging gear 76, so long as rack 78 of sled 32 does not move out of zone 130. While sled 32 moves such that rack 78 is retained in zone 130, the sled may perform duties such as wiping printhead 18 (see FIG. 1), and positioning spit platform 34 below printhead 18 (see FIG. 1) for spitting there from. During these operations capping system 50 may remain in a lowered position such that sled 32 moves over cap 54 without contact there between.

Figure 7:
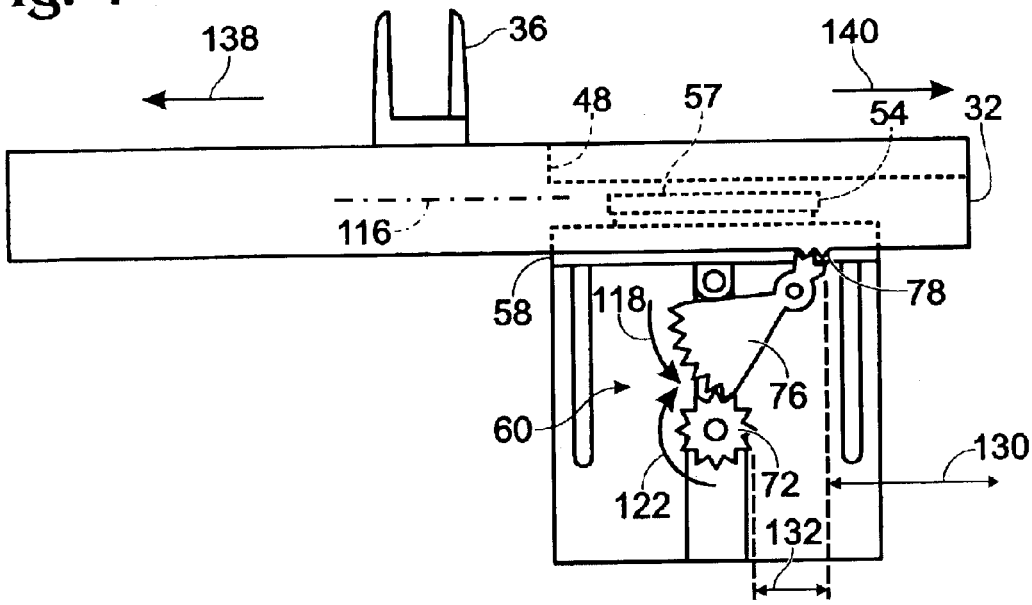
Figure 8:
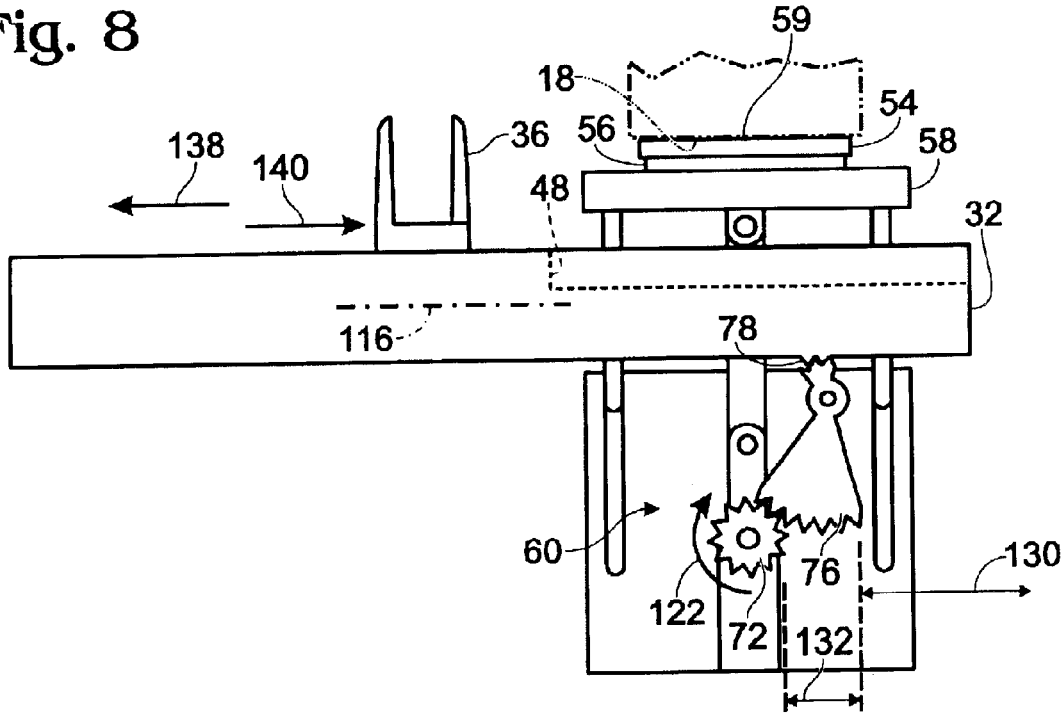

FIG. 7 shows sled 32 having moved in direction 138 from the view shown in FIG. 6. Rack 78 is shown just leaving zone 130 and entering zone 132. FIG. 8 shows sled 32 having moved further in direction 138 and through zone 132 such that rack 78 of sled 32 is just leaving zone 132. Movement of rack 78 of sled 32 through zone 132 may result in contact of rack 78 with gear 76 of crank arm assembly 60 which in turn may cause rotation of gear 76 in direction 118 through about an angle of approximately thirty degrees. Rotation of gear 76 through angle 118 may cause rotation of gear 72 through about angle 122 of approximately one hundred and eighty degrees. Rotation of gear 72 through angle 122 may cause corresponding rotation of crank arms 68*a* and 68*b* and corresponding rotation of linkage arm 62 which may result in movement of cap 54 from its lowered position shown in FIG. 6 to its raised and, if the printhead is present, to its printhead engaging position shown in FIG. 8. Movement of cap 54 upwardly beyond axis 116 of sled 32 may be possible due to cutaway region 48 of sled 32.

Figure 9:
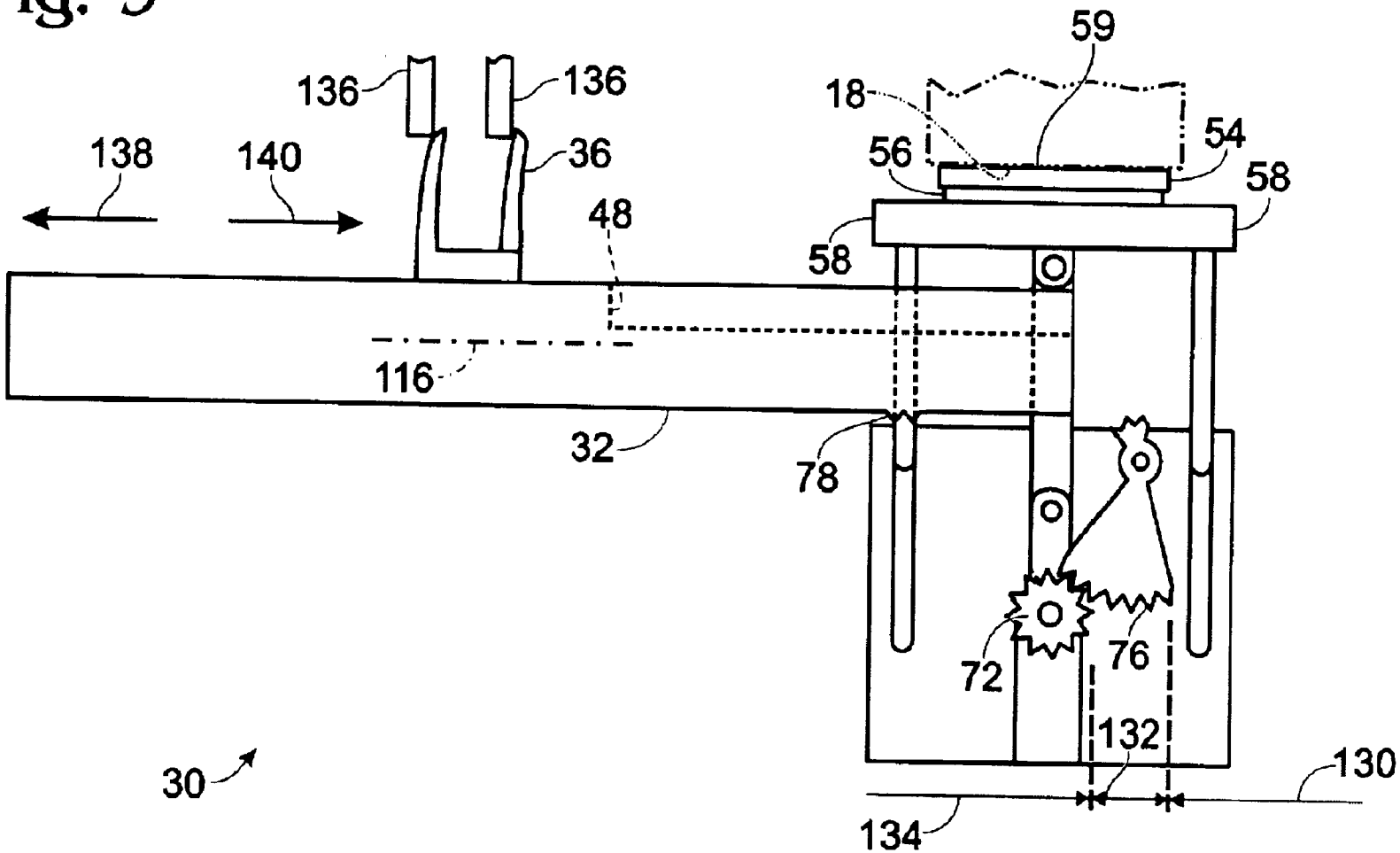

FIG. 9 shows sled 32 having moved further in direction 138 from the view shown in FIG. 8 such that rack 78 may be positioned in a zone 134. Movement of sled 32 in direction 138 such that rack 78 is positioned in zone 134 may not effect movement of gears 72 or 76 such that cap 54 may remain in the raised and printhead engaging position shown in FIG. 8. Accordingly, sled 32 may move through zone 134 for predetermined operations, such as scraping of wipers 36 against scrapers 136, while cap 54 remains capped on printhead 18. Scrapers 136 may be secured to housing 14 or to another structure as desired for a particular application. Alternatively, printhead 18 may not be present such that cap 54 will remain in a raised positioned but not capped on the printhead. In this manner, wipers 36 may be scraped with printhead 18 not present, or if the printhead is present, the printhead will be capped by cap 54.

Return movement of sled 32 in direction 140 may act to lower cap 54 once rack 78 is moved from zone 134 back into zone 132. Continued movement of rack 78 in direction 140 and through zone 132 may result in full lowering of cap 54 into the lowered position shown in FIG. 6. Continued movement of rack 78 into and throughout zone 130 may not act to raise cap 54 from its lowered position.

The illustrated embodiment of servicing mechanism 30 of the present invention may allow cap 54 to be moved into engagement with printhead 18 without requiring simultaneous movement of wipers 36 across scrapers 136. This may eliminate unnecessary scrape events with the printhead carriage 20 (see FIG. 1) and the printhead 18 being present, which may reduce ink flung onto the printhead and the printhead carriage. This non-simultaneous operation may also reduce wear and tear on the wipers and the scrapers because capping may occur without simultaneous scraping of the wipers. Additionally, scraping of wipers 36 may be conducted after cap 54 has already been raised such that the torque requirements required by shaft 46 (see FIG. 1) are less than in embodiments wherein capping and wiping take place simultaneously. Furthermore, movement of cap 54 into engagement with printhead 18 may take place with "y-directional movement" such that the capping system of the present invention may require only a relatively small amount of space within printing mechanism 10. Such y directional movement may allow the storage dimension requirement of cap carrier 58 to correspond almost exactly with the size of the printhead desired to be capped. In the embodiment shown, the size of the printhead 18 may be defined as the horizontal area of the printhead surface containing printhead nozzles through which the printhead ejects ink. In other words, increasing the size of the printhead that is desired to be capped may increase the size of the cap carrier storage dimension by approximately the same amount, i.e., a one-to-one correspondence in size increase of both the printhead and the cap storage dimensions. In contrast, prior art capping systems that require inclined or ramped movement of a sled into position against a printhead may require a much longer increase in ramp length in proportion to the increase in printhead size. The capping system of the present invention, therefore, may be easily sized for a variety of different sized printing mechanisms.

Other enhancements may be made to the capping system wherein such variations and modifications of the concepts described herein fall within the scope of the claims below.

We claim:

1. A printhead servicing mechanism, comprising:

a printhead capping device that moves between a storage position and a printhead capping position;

a crank arm assembly that moves said printhead capping device between said storage and capping positions; and a gear assembly and a servicing sled, wherein said gear assembly operates said crank arm assembly, and wherein said gear assembly is actuated by said servicing sled.

2. A printhead servicing mechanism according to claim 1 wherein said crank arm assembly comprises a crank arm and a linkage arm, wherein rotational movement of said crank arm and said linkage arm imparts motion to said capping device between said storage and capping positions.

3. A printhead servicing mechanism according to claim 2 wherein said motion of said capping device comprises linear movement between, and only perpendicular to, a cap storage plane and a printhead capping plane.

4. A printhead servicing mechanism according to claim 1 wherein said gear assembly comprises a compound gear assembly.

5. A printhead servicing mechanism according to claim 1 wherein said servicing sled includes a rack that selectively actuates said gear assembly, and wherein said sled moves along a sled path of movement and actuates said gear assembly in only a portion of said path of movement.

6. A printhead servicing mechanism according to claim 1 wherein said servicing sled includes a wiper.

7. A printhead servicing mechanism according to claim 1 wherein said servicing sled includes a spittoon.

8. A printhead servicing mechanism for servicing a printhead that defines a printhead plane, comprising:

a capping device adapted for movement between a retracted position and a capping position, said movement of said capping device taking place only along a capping axis positioned perpendicular to said printhead plane; and a crank assembly operatively connected to said capping device and adapted for moving said capping device along said capping axis between said retracted and capping positions;

wherein said crank assembly comprises a crank arm and a linkage arm, a first end of said crank arm connected to a gear system adapted for rotating said crank arm and a second end of said crank arm connected to a first end of said linkage arm, a second end of said linkage arm connected to said capping device, wherein rotation of said crank arm causes swinging movement of said linkage arm, and wherein said swinging movement of said linkage arm moves said capping device along said capping axis.

9. A printhead servicing mechanism according to claim 8 further comprising a gear system operatively connected to said crank assembly, said gear system actuated by a servicing sled so as to actuate said crank assembly to move said capping device along said capping axis.

10. A printhead servicing mechanism according to claim 9 further comprising a servicing sled including a wiper for wiping said printhead, said sled including a rack adapted for engaging said gear system so as to move said capping device along said capping axis.

11. printhead servicing mechanism according to claim 10 wherein said servicing sled moves along a servicing sled axis of movement, and wherein said rack of said servicing sled is disengaged from said gear system in a portion of said axis of movement.

12. A printhead servicing mechanism according to claim 8 further comprising a support structure that constrains said capping device from movement perpendicular to said capping axis.

13. A printhead servicing mechanism according to claim 8 wherein said gear system comprises a first gear connected to said crank arm and a second gear operatively connected to said first gear, said second gear being larger than said first gear and adapted for rotation by contact with a servicing sled.

14. A printhead servicing mechanism according to claim 13 wherein rotation of said second gear through an angle in a range of one to forty degrees causes rotation of said first gear through an angle in a range of one hundred and seventy to one hundred and ninety degrees, and wherein rotation of said first gear through said angle of one hundred and seventy to one hundred and ninety degrees causes rotation of said crank arm through an angle in a range of one hundred and seventy to one hundred and ninety degrees.

15. A printhead servicing mechanism according to claim 14 wherein a length of said crank arm is less than a travel distance of said capping device along said capping axis between said retracted and capping positions.

16. A printhead servicing mechanism according to claim 15 wherein said length of said crank arm is half of said capping device travel distance along said capping axis between said retracted and capping positions.

17. A printhead servicing mechanism for servicing a printhead that defines a printhead plane, comprising:

a capping device adapted for movement between a retracted position and a capping position, said movement of said capping device taking place only along a capping axis positioned perpendicular to said printhead plane; and a crank assembly operatively connected to said capping device and adapted for moving said capping device along said capping axis between said retracted and capping positions wherein said capping device comprises a cap mounted on a cap carrier supported by a support structure, said cap carrier including a plurality of projections retained within grooves of said support structure wherein retention of said projections within said grooves restrains said capping device against movement in any direction perpendicular to said capping axis.

18. A printhead servicing mechanism according to claim 17 further comprising a cap gimbal positioned between said cap and said cap carrier, said cap gimbal allowing rocking movement of said cap with respect to said cap carrier.

19. A printhead servicing assembly, comprising:

a servicing sled including a wiper for wiping a printhead;

a gear system rotated by contact with said sled;

a linkage device actuated by said gear system; and a cap moved into a printhead capping position by said linkage device.

20. A printhead servicing assembly according to claim 19 wherein said servicing sled includes a plurality of teeth positioned on a lower surface of said servicing sled, and wherein said gear system comprises first and second compound, mating gears, said first gear positioned for rotational contact with said plurality of teeth as said sled is moved along a sled axis of movement and wherein said rotational contact of said first gear causes rotation of said second gear which rotates said linkage device.

21. A printhead servicing assembly according to claim 20 wherein said linkage device comprises a crank arm connected to a linkage arm, wherein said linkage arm is positioned substantially adjacent said crank arm when said cap is in a storage position and wherein said linkage arm is positioned substantially outwardly of said crank arm when said cap is in said capping position.

22. A printing mechanism, comprising:

a printhead adapted for ejecting ink there from;

a cap;

a cap carrier having said cap secured thereto; and an actuation mechanism comprising first and second arms pivotally connected together by a fastening device, wherein said fastening device moves through an arc as said cap carrier is moved between a sealing position and a storage position;

wherein said fastening device moves through an angle in a range of one hundred and seventy to one hundred and ninety degrees as said cap carrier is moved between said sealing position and said storage position.

23. A printing mechanism according to claim 22 further comprising a servicing sled that includes a wiper for wiping said printhead and a rotation device for actuating said actuation mechanism.

24. A printing mechanism according to claim 22 wherein said printing mechanism comprises an inkjet printer.

25. A method of capping a printhead, comprising:

rotating a crank arm;

moving a printhead cap from a storage position to a printhead capping position by said rotation of said crank arm; and advancing a servicing sled into operable contact with said crank arm so as to rotate said crank arm.

26. A method according to claim 25 further comprising the step of further rotating said crank arm, which in turn moves said printhead cap from the capping position to the storage position.

27. A printhead servicing mechanism comprising:

means for capping a printhead; and crank means for moving said means for capping a printhead into capping engagement with a printhead, wherein said crank means comprises first and second pivoting means connected together by fastening means, wherein said fastening means moves through an angle in a range of one hundred and seventy to one hundred and ninety degrees as said means for capping is moved between a sealing position and a storage position.

28. A printhead servicing mechanism according to claim 27 wherein said crank means comprises a crank arm that moves through an angle of at least one hundred and seventy degrees during movement of said printhead capping means from a storage position to a printhead capping position.

29. A method of capping a printhead, the method comprising:

horizontally advancing a servicing sled into contact with a lifting mechanism, the lifting mechanism having a cap thereon; and actuating the lifting mechanism by the contact to vertically lift the cap into contact with a printhead.

30. A printhead servicing mechanism for servicing a printhead that defines a printhead plane, comprising:

a capping device adapted for movement between a retracted position and a capping position, said movement of said capping device taking place only along a capping axis positioned perpendicular to said printhead plane; and a crank assembly operatively connected to said capping device and adapted for moving said capping device a travel distance along said capping axis between said retracted and capping positions, wherein a length of said crank arm is at most half of said capping device travel distance.

31. A printhead servicing assembly, comprising:

a cap moved into a printhead capping position by a linkage device;

a linkage device including a crank arm connected to a linkage arm, wherein said linkage arm is positioned substantially adjacent said crank arm when said cap is in a storage position and wherein said linkage arm is positioned substantially outwardly of said crank arm when said cap is in said capping position.

* * * * *